US010052890B2

(12) United States Patent
Solans et al.

(10) Patent No.: US 10,052,890 B2
(45) Date of Patent: Aug. 21, 2018

(54) TARGET FOR A PRINTING AND CUTTING PROCESS

(71) Applicant: HEWLETT-PACKARD DEVELOPMENT COMPANY, L.P., Houston, TX (US)

(72) Inventors: Joan Solans, Sant Cugat del Valles (ES); Charlie Yang, Los Angeles, CA (US); James Dowling, Alpharetta, GA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/547,738

(22) PCT Filed: Apr. 17, 2015

(86) PCT No.: PCT/EP2015/058388

§ 371 (c)(1),
(2) Date: Jul. 31, 2017

(87) PCT Pub. No.: WO2016/165774

PCT Pub. Date: Oct. 20, 2016

(65) Prior Publication Data

US 2018/0022118 A1 Jan. 25, 2018

(51) Int. Cl.
*B41J 11/70* (2006.01)
*B41J 11/66* (2006.01)

(52) U.S. Cl.
CPC ..... *B41J 11/663* (2013.01); *B41J 11/70* (2013.01)

(58) Field of Classification Search
CPC . B41J 11/66; B41J 11/663; B41J 11/70; B41J 11/703; B41J 2/442; B41J 13/00; B41J 13/0009; B41J 15/046; B41J 15/044; B41J 15/04; B41J 15/00; B41J 15/048; B41J 2/325; B41J 3/4075; B41J 15/042; B41J 2202/34; G03G 2215/00814
See application file for complete search history.

(56) References Cited

U.S. PATENT DOCUMENTS 5,159,350 A * 10/1992 Minaminaka ..... B41J 11/703 347/218
5,529,441 A 6/1996 Kosmowski et al.
7,059,061 B2 6/2006 French
8,562,229 B2 * 10/2013 Inaba ..... B41J 11/703 400/621
8,888,388 B2 * 11/2014 Mochida ..... B41J 11/70 400/621
8,911,166 B2 * 12/2014 Tsukada ..... B41J 11/70 400/621
8,924,002 B2 12/2014 Andersen et al.
(Continued)

OTHER PUBLICATIONS

Designing & Submitting Artwork; Pirates Press; priratespress.com; Nov. 15, 2010; pp. 1-12.

*Primary Examiner* — Kristal Feggins
(74) *Attorney, Agent, or Firm* — HP Inc. Patent Department

(57) ABSTRACT

A method is provided. The method includes printing a target on a medium and defining at least one intended cutting line on the medium. The target includes at least one graphical element which defines at least one reference distance measure. The target is centered at the intended cutting line or has a defined distance to the intended cutting line.

15 Claims, 7 Drawing Sheets

(56) References Cited

U.S. PATENT DOCUMENTS

| | | | | |
|---|---|---|---|---|
| 2003/0232578 | A1 | 12/2003 | Hayashi | |
| 2006/0082637 | A1* | 4/2006 | Sanbongi | B41J 2/325 347/213 |
| 2007/0181027 | A1 | 8/2007 | Kanazawa | |
| 2012/0224907 | A1 | 9/2012 | Serizawa | |

* cited by examiner a)

b)

a)

b)

TARGET FOR A PRINTING AND CUTTING PROCESS

BACKGROUND

In printing and cutting processes graphical objects, also referred to as artwork, are printed on a medium. Later, the medium is cut along cutting lines, which are also referred to as trim lines or crop marks, or along contour cutting paths. The medium may be a sheet of paper or a foil, for example.

DETAILED DESCRIPTION

When cutting printed objects from a media sheet, for example using a contour cutter, there is the risk that the medium was uniformly or non-uniformly distorted during the printing process or afterwards. Further, the printing process may have been misaligned with respect to the media sheet. As a result, the cutting tool may not pass, at sufficient accuracy, along the intended cutting line which may have been defined by the graphic designer together with the printed artwork, for example. Cutting errors may be visible, e.g. as white areas along the cutting line, if the error exceeds the amount of bleeding, i.e. the amount by which the printed object extends beyond the intended cutting line. For assessing the accuracy of the cutting process with respect to the printed object on the media sheet, different parts of the cut media may be inspected after printing and may be analyzed, e.g. for white edges.

Figure 1:
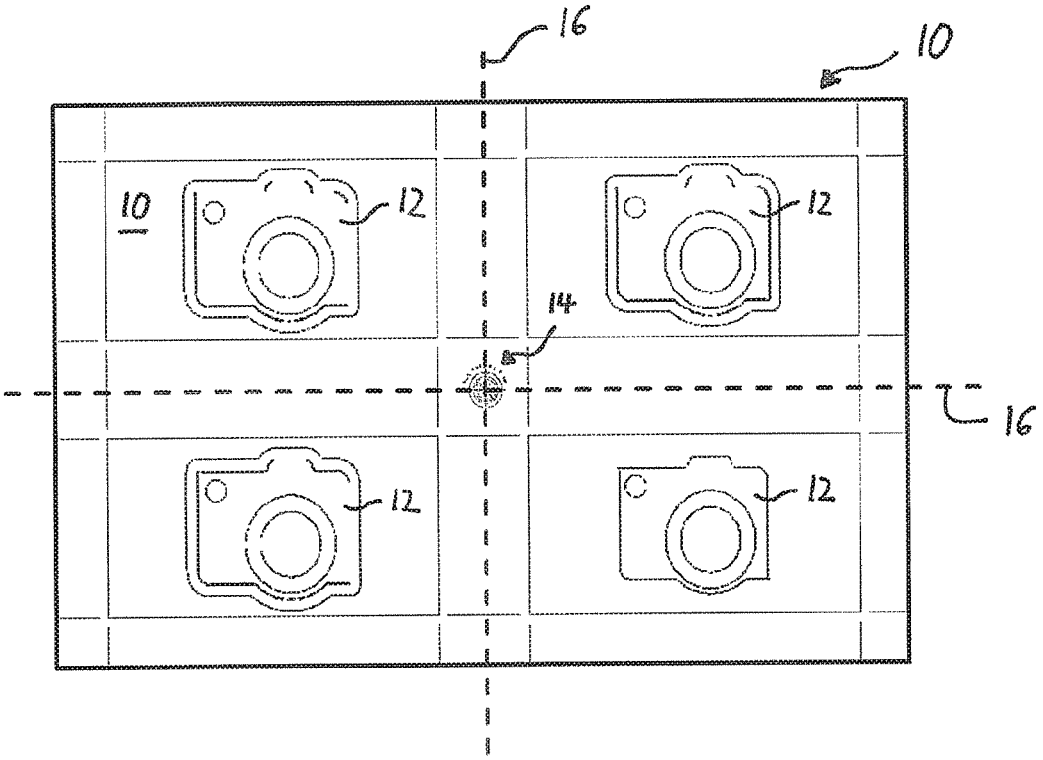
FIG. 1 shows a media sheet with a printed target thereon which may be used according to an aspect of the present disclosure.

FIG. 1 is a plan view of a media sheet 10 which may be used in a printing and cutting process according to an aspect of the present disclosure. On the media sheet 10, plural graphical objects 12 are printed in combination with a target 14. The media sheet 10 may be a sheet of paper, cardboard, textile, plastic plate or foil, for example. FIG. 1 further shows a first intended cutting line 16 along the length direction of the media sheet 10 and a second intended cutting line 16 along the transverse direction of the media sheet 10.

The intended cutting lines 16 may define respective paths relative to the graphical objects 12 along which the media sheet is to be cut after the graphical objects have been printed.

The paths of the intended cutting lines 16 can be defined with respect to the graphical objects 12 before the printing process by the graphics designer. In some examples, the intended cutting lines 16 are printed on the media sheet 10 together with at least one graphical object 12. In other examples, the intended cutting lines 16 are not printed and do not appear on the medium but correspond to the information of their paths, i.e. orientation, direction and position, relative to the graphical objects 12 and/or relative to the medium 10. The information of an intended cutting line 16 can be used by a cutting device for cutting the media sheet. In some examples, the cutting device may be part of a combined printing and cutting system. In other examples, the cutting device may be dedicated for cutting only.

Figure 2:
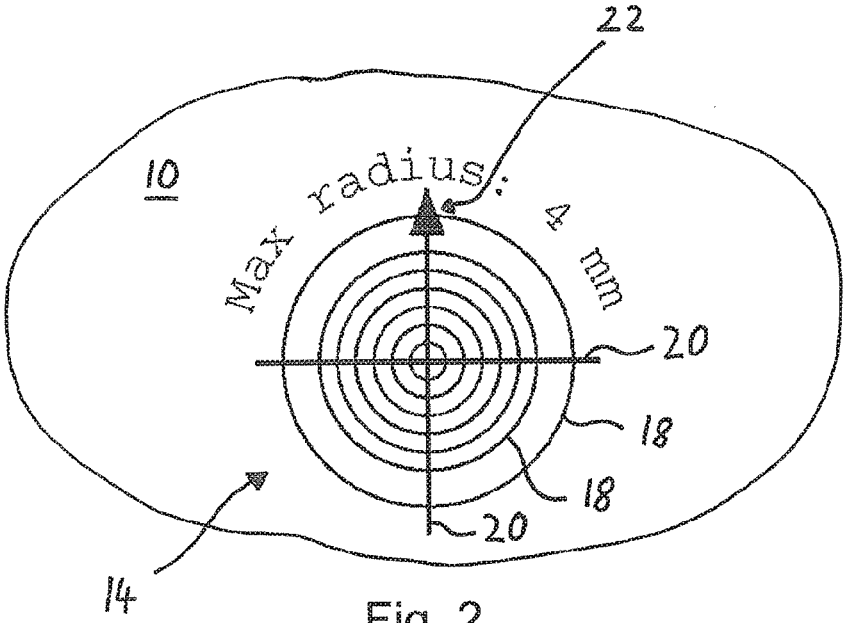
FIG. 2 shows the target of FIG. 1 which may be used according to an aspect of the present disclosure.

FIG. 2 is an enlarged view of the target 14 of FIG. 1 which is printed on the media sheet 10. In the example of FIG. 2, the target 14 comprises plural graphical elements corresponding to a number of concentric circles 18 having different radii. When the target includes multiple concentric circles, the distance between the circles may vary. For example, the outer circles can have larger distances and the inner circles can have smaller distances. The distances from the outer circle to the inner circle can decrease from 2 mm to 0.5 mm or from 1 mm to 0.5 mm, for example. Further, there may be a larger number of "inner" circles having a smaller distance than outer circles having a larger distance. In the example shown in FIG. 2, the target comprising seven concentric circles, with the radius of the outer circle being 2 mm, the radius of the second outer circle being 3 mm, and the radius of the further inner circles decreasing in steps of 0.5 mm. In this example, the smallest inner circle hence has a radius of 0.5 mm, and the distance between the six inner circles is 0.5 mm between respective two neighboring circles.

Different circle sizes, different numbers of circles and different distances between circles may be chosen. Further, targets having graphical elements of different shapes may be designed.

The target 14 of FIG. 2 also comprises an indication of a value of a reference distance measure of the target 14, namely the indication "max radius: 4 mm". Each radius of the circles 18 may represent a respective reference distance measure of the printed target 14. In the example of FIG. 2, each reference distance measure of the printed target 14 is defined and visualized by a corresponding circle 18 the reference distance measure(s) may be used for assessing cutting accuracy, as will be explained further below.

Additionally, the printed target 14 of FIG. 2 comprises two lines 20 and a mark 22. The mark 22 may indicate the orientation of the target 14 relative to the arrangement of the graphical objects 12, relative to the intended cutting lines 16 and/or relative to the media sheet 10. The function of the mark 22 will be explained in more detail further below.

When the target 14 is printed on a media sheet 10, the lines 20 may be aligned with corresponding intended cutting lines 16. In other words, the lines 20 may be an exact graphical representation of the intended cutting lines 16. In this case, the lines 20 visualize the paths of the intended cutting lines 16 or portions thereof, where the medium is to be cut relative to the graphical objects 12 and/or boundaries of the medium 10.

Referring to FIG. 3*a* to 3*d*, which show another example of a target 114, the use of the target 114 according an aspect of the present disclosure is explained. The target 114 of FIG. 3*a* comprises only one graphical element, namely a circle 18, which is printed on a medium 10 and which is centered with respect to an intended cutting line 16. The radius of the circle 18 corresponds to a reference distance measure of the target 114. In the present disclosure, a reference distance measure corresponds to an actual distance on a medium and can be assigned to a target. If targets are printed at different sizes, the reference distance measures of the printed targets will be different. For example, the reference distance measure of the printed target 114 of FIG. 3*a*, e.g. the radius of the circle 18, may be 1 mm. In other examples, the target 114 can be printed at other sizes and therefore can provide other reference distance measures, e.g. within the range of 0.5 mm to 4 mm, as explained with reference to FIG. 2.

When the medium 10, on which the target 114 is printed and for which the intended cutting line 16 has been defined, is cut, the actual cutting line 24 may deviate from the intended cutting line 16 as shown in FIG. 3*a*. This deviation might be caused, for example, by a misalignment between the printing process and the cutting process and/or by a distortion of the medium 10. Cutting along the actual cutting line 24 in FIG. 3*a* cuts the medium 10 into two parts. Portions of the parts are shown in FIG. 3*b* (lower part of FIG. 3*a*) and FIG. 3*c* (upper part of FIG. 3*a*).

Both of the parts shown in FIGS. 3*b* and 3*c* may be used to assess the accuracy by which the medium 10 has been cut with respect to the intended cutting line 16. From the part shown in FIG. 3*b*, it can be recognized that the remaining portion of the circle 18 and the cutting edge 26 form a circle section being less than half a circle. This means that the cutting edge 26, which coincides with the actual cutting line 24, has a distance to center of the circle 18 which is larger than zero and smaller than the reference distance measure corresponding to the radius of the circle 18. Accordingly, if the center of the printed circle 18 is defined to coincide with the intended cutting line 16, it can be recognized from the part of FIG. 3*b* that the cutting error is larger than zero and smaller than the reference distance measure. A similar assessment leading to the same result is possible by inspecting the complementary part of FIG. 3*c*, which shows a remaining portion of the printed circle 18 which is less than a full circle but more than half a circle. This allows for the qualitative and quantitative determination that the cutting error is smaller than the reference distance measure and larger than zero.

In the example of FIG. 3*d* a part of a medium, with the target 114 printed thereon, is shown which would result from a cutting process along another actual cutting line different from the actual cutting line 24 shown in FIG. 3*a*. If the result of the cutting process is as shown in FIG. 3*d*, and if the target 114 was centered with respect to an intended cutting line 16, it can be determined from the part shown in FIG. 3*d* that the cutting error is larger than the reference distance measure, because the actual cutting line does not intersect the circle 18. From the part of FIG. 3*d* it can be recognized that the cutting error is about 1.5 reference distance measures, assuming that the intended cutting line 16 intersects the center of the circle 18. If, for example, the reference distance measure is chosen to be 0.5 mm, it can be concluded that the cutting error is in a range between 0.5 mm and 1 mm and is about 0.75 mm.

It is not mandatory that the target 114 is centered with respect to the intended cutting line 16. In other examples, the target 114 may have a defined distance from the intended cutting line 16, wherein this distance can be taken into account when inspecting a part of cut medium containing at least a part of the printed target 114 for assessing the cutting accuracy. For example, the target can have a defined position relative to the intended cutting line, which is offset from the intended cutting line in a direction transverse to the path of the intended cutting line. For example, for the printing and cutting process which is assessed by inspecting the part of FIG. 3*d*, the intended cutting line may have been defined to coincide with a line A, which is a tangent to the circle 18, as shown in FIG. 3*d*. In this case, it can be recognized from inspecting the part of FIG. 3*d*, that the cutting error is less than the reference distance measure of target 114 and corresponds to about half the reference distance measure, because the distance of the tangent line A (and the circumference of the circle 18) from the cutting edge 26 corresponds to about half the radius of circle 18, in FIG. 3*d*.

Figure 4:
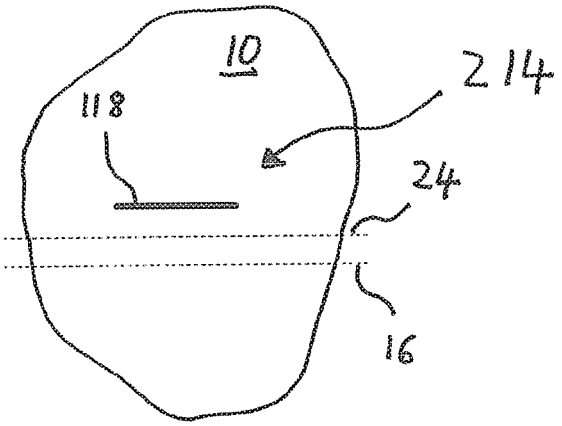
FIG. 4 shows a further target which may be used according to an aspect of the present disclosure.
Figure 4:
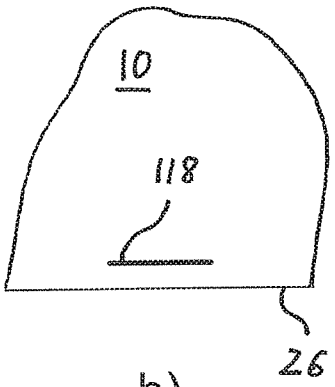

In FIG. 4, another example 214 of a target is shown, which allows for an assessment of a cutting accuracy according to an aspect of the present disclosure. FIG. 4*a* shows a part of a medium 10 carrying a printed target 214 thereon which, in this example, comprises just one graphical element, namely a straight line segment 118. In this example, the length of the printed line segment 118 corresponds to the reference distance measure of the target 214. The straight line segment 118 of the target 214 has a predetermined distance from a corresponding intended cutting line 16. This distance is used when assessing the cutting accuracy. In the example of FIG. 4, the predetermined distance of the intended cutting line 16 to the line segment 118 corresponds to half the reference distance measure, which is defined by the length of the straight line segment 118. In other examples, the ratio between the predetermined distance and the reference distance measure of target 214 may be different.

FIG. 4*b* shows a part of a medium 10 after a cutting process along the actual cutting line 24 (shown in FIG. 4*a*). From the part shown in FIG. 4*b*, it can be recognized that the distance from the line segment 118 to the cutting edge 26, which corresponds to the actual cutting line 24, in this example is about a quarter of the length of the line segment 118, which defines to the reference distance measure of target 214. Because, in the example of FIG. 4, the predetermined distance is half the reference distance measure, the inspection of the part shown in FIG. 4*b* allows to determine that the cutting error is about a quarter of the reference distance measure.

This inspection may be performed by any suitable person or tool using optical inspection. Accordingly, the cutting accuracy can be assessed qualitatively and quantitatively efficiently. Further, the part can be used as a proof for accuracy. Depending on the accuracy of the process, the target size can be adjusted accordingly. In some examples, in which the cutting process is highly accurate, magnifying glasses, a microscope or similar devices may be used for the assessment.

Figure 5:
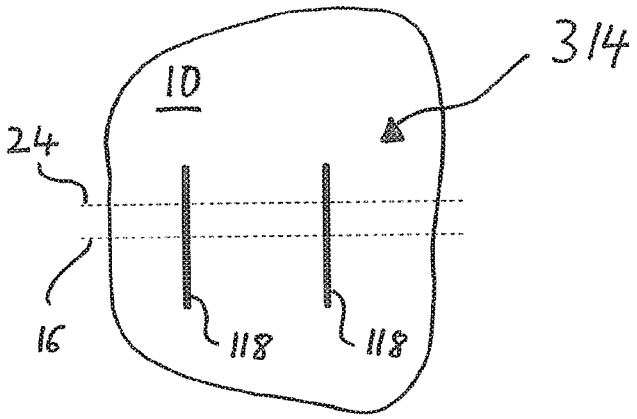
FIG. 5 shows a similar target as illustrated in FIG. 4 which may be used according to an aspect of the present disclosure.
Figure 5:
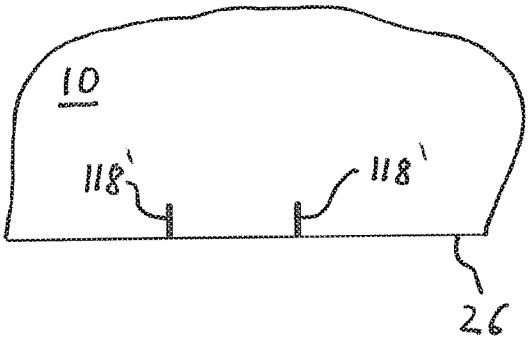
Figure 6:
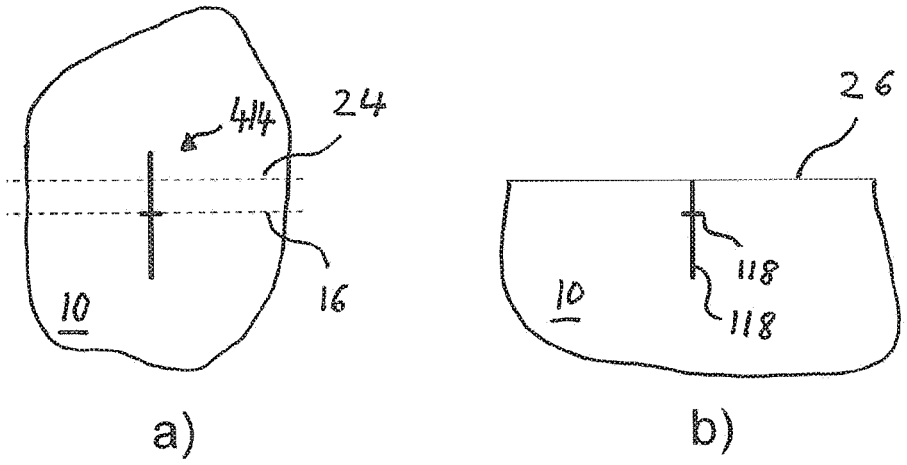
FIG. 6 shows a further target which may be used according to an aspect of the present disclosure.

Further examples of targets which can be used to assess the cutting accuracy according to aspects of the present disclosure are illustrated in FIGS. 5 and 6.

The target 314 of FIG. 5 comprises two graphical elements in the shape of two parallel straight line segments 118 of equal length and provides two different reference distance measures, namely a first reference distance measure corresponding to the length of the line segments 118 and a second reference distance measure corresponding to the distance of the line segments 118. A cutting process, wherein the medium 10 is cut in a direction transverse to a direction of the line segments 118, as indicated in FIG. 5*a*, can be assessed by comparing the length of the line segments 118, which remain on a cut part, such as the part shown in FIG. 5*b*, to the second reference distance measure defined by the distance of the line segments 118 on the part. In the example shown in FIG. 5*a*, the intended cutting line 16 is assumed to intersect each of the line segments 118 in the center and the first and the second reference distance measures are equal. That is, the length of each line segment 118 is equal to the distance between the two line segments 118. By inspecting the part of FIG. 5*b*, it can be recognized that the distance from each end of each line segment 118 to the cutting edge 26 is about a quarter of the second reference distance measure, i.e. the distance between the two line segments 118'. This information can be obtained by optically inspecting the part of FIG. 5*b*. Accordingly, in this example, the part shown in FIG. 5*b* may help keep the level of the cutting error at about a quarter of the second reference distance measure.

The first reference distance measure of the target 314 of FIG. 5, i.e. the length of the line segments 118, also can be used for the assessment of a cutting process in a direction parallel to the straight line segments 118, as has been explained with reference to FIG. 4.

The target 414 shown in FIG. 6 comprises a graphical element including two straight line segments 118 which form a cross. In the example shown in FIG. 6*b*, a reference distance measure of the target 414 is visualized and defined by the distance between the intersection of line segments 118 and the lower or upper end of the vertical line segment 118 or both, wherein the vertical line segment 118 is perpendicular to the intended cutting line 16. Assuming that the intended cutting line 16 intersects the cross of line segments 118 (as shown in FIG. 6*a*), in this example, the part of medium shown in FIG. 6*b* may help keep the level of the cutting error at about half of the reference distance measure of target 414.

Figure 3:
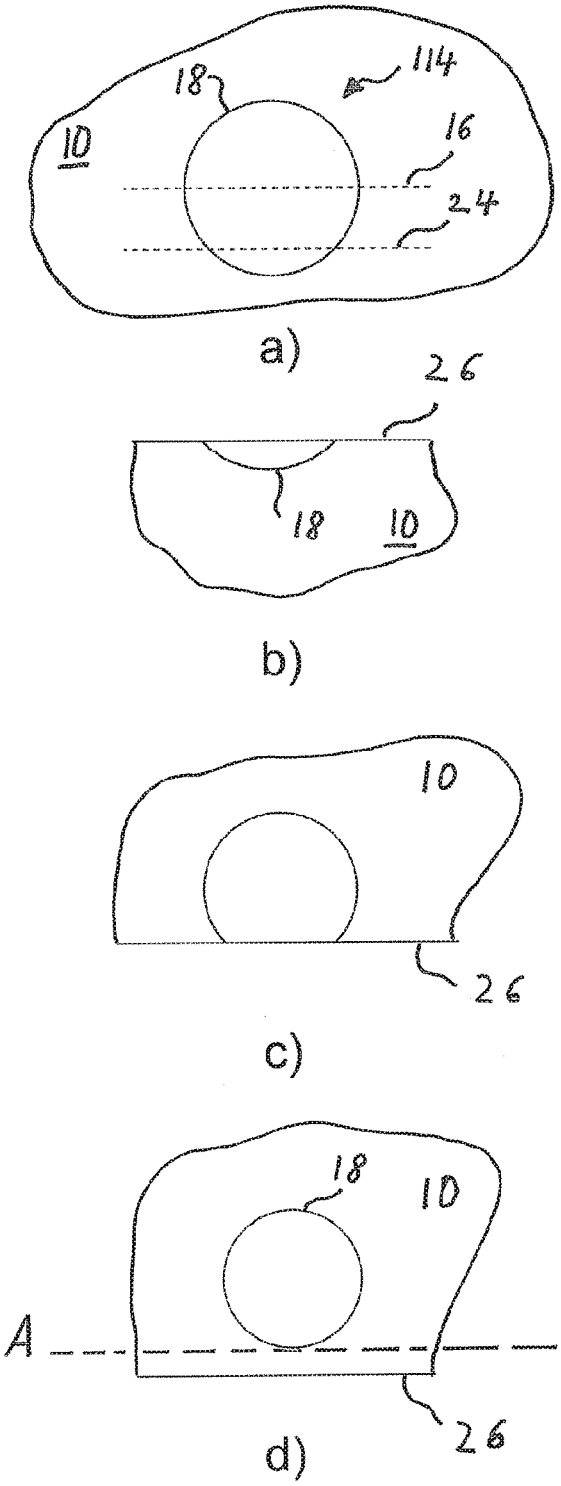
FIG. 3 shows another example of a target which may be used according to an aspect of the present disclosure.

When using one of the above targets 214, 314, and 414, which comprise straight line segments 118, for quantitatively assessing a cutting error, the complete reference distance measure should be visualized on the inspected part of the cut medium and should be directly perceivable from this part. This is different when using the target 114 of FIG. 3, which comprises a circle section, for quantitatively assessing a cutting error. For example, when using the part of cut medium 10 shown in FIG. 3*b*, showing less than half a circle, the reference distance measure, i.e. the radius of the circle 18, is not completely visualized on the part of FIG. 3*b* and is not directly perceivable from the circle section. However, because of the specific symmetry of a circle, depending on the size of the circle section, relative to a full circle, it is possible to determine the distance between the cutting edge 26 and the circle center in terms of the radius, which corresponds to the reference distance measure. The part of cut medium of FIG. 3*b*, for example, comprises a circle section which is less than half a circle and, more specifically, corresponds to a circle portion which allows for the assessment that the distance between the cutting edge 26 and the circle center is about two third of the radius. Accordingly, a quantitative assessment can be possible, even though the reference distance measure (i.e. radius) may not be directly or fully visualized on the part of medium. For the example of a circle, the reference distance measure can be visualized and defined by the curvature of the circle.

Figure 7:
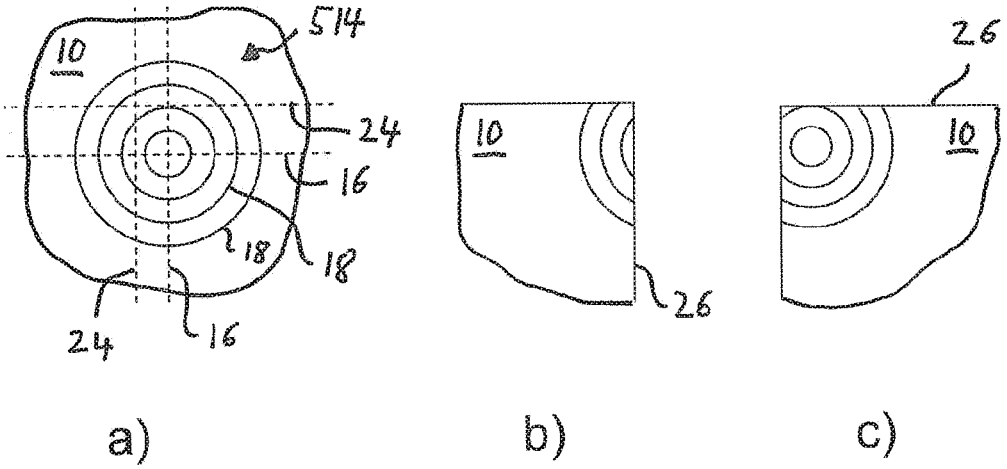
FIG. 7 shows a further target which may be used according to an aspect of the present disclosure.

Referring to FIG. 7, a target 514 is illustrated which also allows for a quantitative assessment of the cutting accuracy without a direct perception of the length of a reference distance measure on the part of cut medium which is used for the assessment. The target 514 comprises four concentric circles 18 which may have a radius of 0.5 mm, 1 mm, 1.5 mm and 2 mm, respectively. In other examples, the radii may have any other values. In the example of FIG. 7, the printed target 514 is centered with respect to two intended cutting lines 16, which intersect in the center of the target 514. FIGS. 7*b* and 7*c* show two parts of cut medium which are selected from the parts which are obtained when cutting the medium 10, shown in FIG. 7*a*, along two perpendicular actual cutting lines 24. In this example, each cut along one of the actual cutting lines 24 has an error with respect to a corresponding parallel intended cutting line 16. The parts of FIGS. 7*b* and 7*c* correspond to the portion at the bottom left and the portion at the bottom right, respectively, which are defined by the intersection of the actual cutting lines 24 in FIG. 7*a*. Because each of the rings 18 defines a corresponding reference distance measure and because at least some rings can be determined on the cut part, e.g. by counting the number of rings of a respective part a quantitative assessment can be performed. The number of rings can be counted starting with the outer ring or starting with the inner ring. From the part of FIG. 7*b*, for example, it can be derived that the vertical cutting edge 26 intersects the second inner circle 18 having a radius of 1 mm but not the inner circle having a radius of 0.5 mm. Accordingly, the cutting error of the vertical cut 24 is between 0.5 mm and 1 mm. In a similar way, the part of FIG. 7*c* allows for an analogue assessment, deriving the same error for the vertical cut and an error of 1 mm for the horizontal cut, because the horizontal cutting edge 26 of FIG. 7*c* is a tangent of the second inner circle 18 of radius 1 mm.

In order to make sure that the cutting edges 26 of the part of cut medium are attributed to the correct cutting direction, e.g. vertical and horizontal, and/or that the part of cut medium is attributed to the correct position on the medium, e.g. left, right, above, below of an intended cutting line, the target may comprise a mark 22, as shown in FIG. 2. The mark 22 indicates the relative orientation of the target or a portion thereof with respect to the medium and/or the intended cutting lines.

For example, the horizontal line 20 of FIG. 2 may define an intended cutting line 16 and the medium 10 may be cut with a cutting error with respect to this intended cutting line 16 along an actual cutting line 24. Due to the cutting error, the cutting edge 26 may be above the horizontal line 20 of FIG. 2 or below this line 20, such that—with respect to the horizontal line 20 in FIG. 2—an upper part of medium 10 will comprise the mark 22 and a lower part of medium 10 will not have any part of the mark 22 thereon. Accordingly, after the cutting process, both parts can be distinguished and identified as "upper" part comprising the mark 22 and "lower" part not comprising the mark 22. If, for example, after the cutting process the part of the medium which includes the mark 22 comprises less/more than half of the target, it can be recognized that the actual cutting line 24 is shifted upwards/downwards with respect to the intended cutting line 16. If, on the other hand, after the cutting process, the part without the mark 22 comprises less/more than half of the target 14, it can be recognized that the actual cutting line 24 is shifted downwards/upwards with respect to the intended cutting line 16. Accordingly, based on the location of the mark 22, the direction of the cutting error can be determined with respect to the corresponding intended cutting line 16. If the intended cutting line 16 has a defined path relative to the medium 10, also the direction of the cutting error with respect to the medium 10 may be determined.

Figure 8:
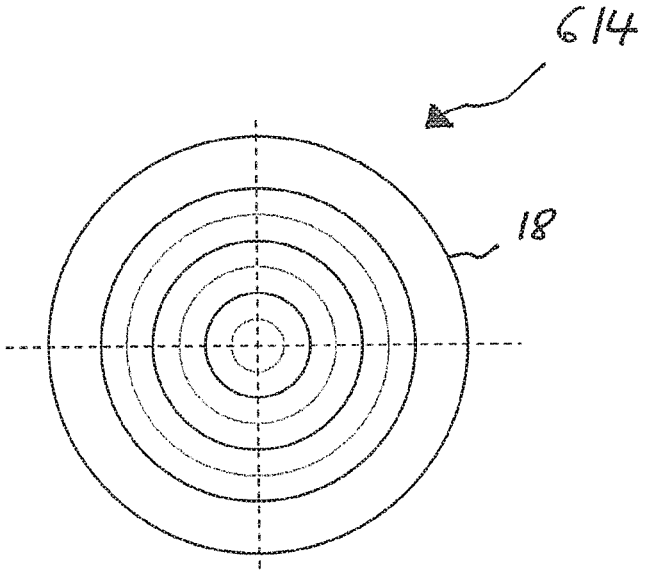
FIG. 8 shows a further target which may be used according to an aspect of the present disclosure.

FIG. 8 illustrates another example of a target 614 comprising seven concentric rings 18 having radii of 0.5 mm, 1 mm, 1.5 mm, 2 mm, 2.5 mm, 3 mm and 4 mm, respectively. The rings having the radii of 0.5 mm, 1.5 mm and 2.5 mm are printed using a brighter color than the other rings which enhances the readability when assessing the cutting accuracy.

When the lines are printed with different colorants, the graphical elements of a target may appear blurred or fuzzy due to a color miss-registration. In case of a color miss-registration the dispensing of different colorants may not be aligned. Therefore the visibility can be enhanced when the rings are printed by using just one colorant. Printers usually have the colorants cyan (C), magenta (M), yellow (Y) and black (K), such that just one of these colorants can be used. However, yellow is sometimes difficult to see on a bright medium and black may be mixed with other colorants (composite black), such that it might be challenging to control that only black ink is laid down during printing and such that the lines may appear soft. Therefore, one may chose cyan or magenta as colorant for printing the target for obtaining clear and visible targets.

For printing the target with only one colorant and for printing at the same time different graphical elements of the target with a different brightness it is possible to use for each brightness a corresponding spot color, i.e. a color which is premixed rather than being mixed during printing, wherein the spot colors contain the same colorant but in a different amount. Because a spot color is not created by mixing different colorants during the printing process, color management during printing and colorant contamination can be avoided. For example, if a target is printed with cyan, a spot color of 100% cyan (dark cyan) and another spot color with 70% cyan (lighter cyan) can be used to print darker rings and lighter rings or other graphical elements, respectively. This can ensure that targets can be printed clear and sharp and are better readable.

Figure 9:
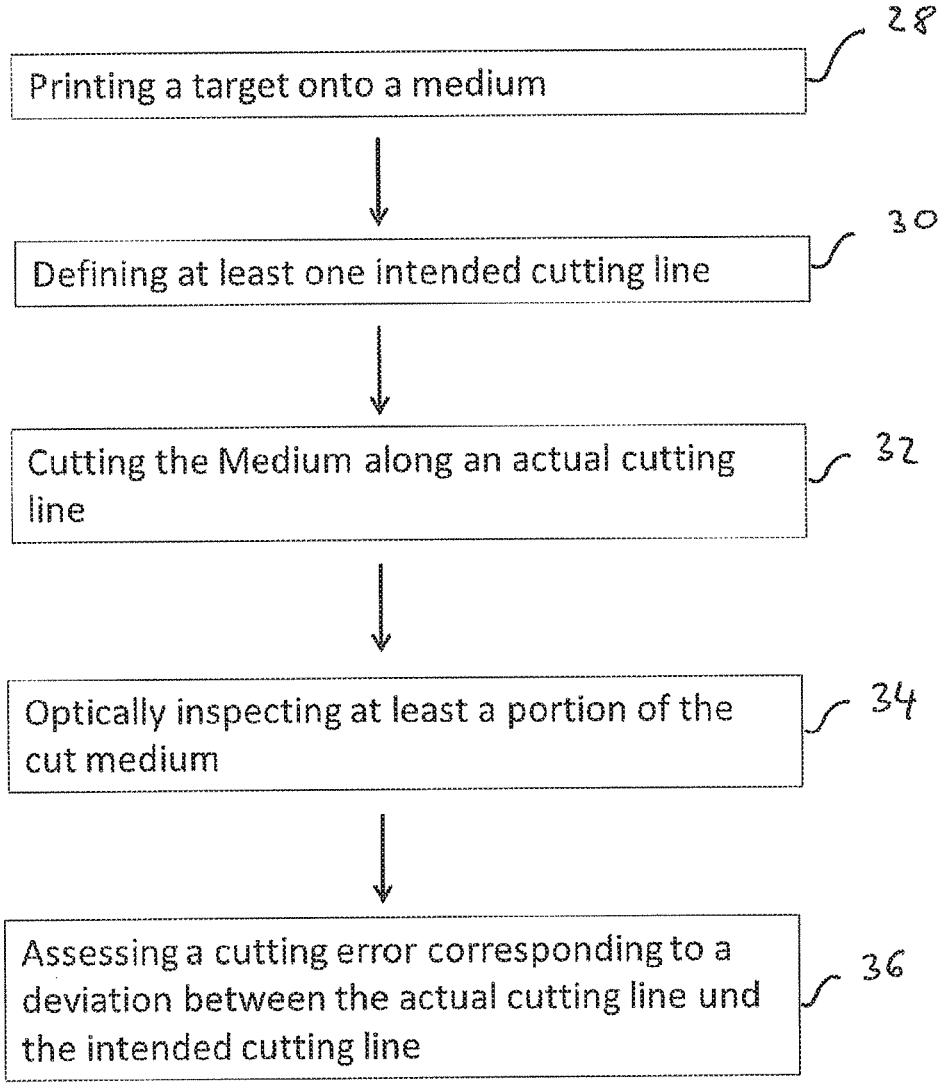
FIG. 9 shows a sequence of a process according to an aspect of the present disclosure.

Referring to FIG. 9, an example of a process for determining a cutting error is illustrated. In a first stage, a target, such as one of the targets of FIGS. 1 to 7, is printed on a medium 10. In a following stage 30, at least one intended cutting line 16 is defined. In some examples, the path of the intended cutting line 16 is defined with respect to the position and the orientation of the target. In other examples, the path of the intended cutting line 16 is defined with respect to the medium 10. In the example of FIG. 9, defining an intended cutting line 16 is performed after printing a target. In other examples, defining can be performed before printing.

Next, as shown in FIG. 9, the medium can be cut 32 along an actual cutting line 24, wherein the path of the actual cutting line 24 may deviate from the path of the intended cutting line 16. The deviation corresponds to a cutting error. Then, as shown in FIG. 9, a portion of the cut medium may be optically inspected 34. This inspection may be performed visually by a person without using a measurement tool. In other examples, the inspection may be performed by an inspection device, for example by use of a scanning process. In a later stage, it can be assessed 36, whether there is a cutting error. The assessment may be qualitative and quantitative or may be quantitative, as explained with regard to FIGS. 1 to 7.

The target hence can be used for optically assessing the accuracy of cutting a medium along an intended cutting line, when the target is printed on the medium and comprises at least one graphical element which defines at least one reference distance measure. For example, the target can be centered at the intended cutting line or can be positioned at a defined distance from the intended cutting line.

LIST OF REFERENCE SIGNS

10 media sheet
12 graphical object
14, 114, 214, 314, 414, 514, 614 target
16 intended cutting line
18, 118 graphical element
20 line
22 mark
24 actual cutting line
26 cutting edge
28, 30, 32, 34, 36 process stages

The invention claimed is:

1. A method comprising:
defining at least one intended cutting line on a medium,
defining a target,
controlling a print engine to print the target on the medium, and
wherein the target comprises at least one graphical element which defines at least one reference distance measure and wherein the target is centered at the intended cutting line or is positioned at a defined distance from the intended cutting line.

2. The method of claim 1, wherein the graphical element comprises at least one of a curved line segment, a ring line, a circle line, a cross of line segments, a polygon, plural separated line segments and a straight line segment.

3. The method of claim 1, further comprising
cutting the medium along at least one actual cutting line, the cutting line extending through the at least one graphical element of the target or at a distance to the target less than three times a diameter of the target, and
determining an amount of a deviation of the actual cutting line from the intended cutting line by optically inspecting at least a part of the target on the cut medium relative to the actual cutting line.

4. The method of claim 1, comprising defining a first intended cutting line and a second intended cutting line, which first and second intended cutting lines are not parallel to each other, wherein relative to each of both of the first and second intended cutting lines the target is centered or is positioned at a defined distance.

5. The method of claim 1, wherein the at least one graphical element of the target comprises a ring, which is intersected by the at least one intended cutting line, wherein a radius of the ring corresponds to a reference distance measure.

6. The method of claim 1, wherein the target comprises a number of concentric rings having different radii.

7. The method of claim 6, wherein at least two intended cutting lines not being parallel and intersecting the center of the rings are defined.

8. The method of claim 6, wherein the rings have radii in a range between 0.5 mm and 4 mm.

9. The method of claim 1, wherein the at least one graphical element is printed using only one colorant.

10. The method of claim 1, wherein the target comprises a number of graphical elements which are printed using at least two different spot colors each containing a different amount of a same colorant.

11. The method of claim 10, wherein the target comprises a number of graphical elements and at least two different graphical elements are printed at different brightnesses.

12. The method of claim 1, wherein the target further comprises a mark indicative of the relative orientation of the target on the medium.

13. The method of claim 1, wherein the target further comprises at least on indication of a value of the at least one reference distance measure.

14. A method of optically assessing the accuracy of cutting a medium along an intended cutting line, wherein a target is printed on the medium and wherein the target comprises at least one graphical element which defines at least one reference distance measure and wherein the target is centered at the intended cutting line or is positioned at a defined distance from the intended cutting line.

15. A non-transitory machine readable medium, stored thereon machine-readable instructions, which, when executed, cause a system to:

print a target on a medium according to target information, and cut the medium according to cutting information, wherein the cutting information defines an intended cutting line, along which the medium is intended to be cut, and wherein the target comprises at least one graphical element which defines at least one reference distance measure and is centered at the intended cutting line or is positioned at a defined distance from the intended cutting line.

* * * * *